US006742504B2

(12) United States Patent
Seymour, II et al.

(10) Patent No.: US 6,742,504 B2
(45) Date of Patent: Jun. 1, 2004

(54) PRESSURE WAVE ATTENUATOR FOR A RAIL

(75) Inventors: Kenneth R. Seymour, II, Villa Park, IL (US); Sidi Ould Sadfa, Chicago, IL (US); Ning Lei, Oak Brook, IL (US); James H. Yager, St. Charles, IL (US); Xilin Yang, Streamwood, IL (US); Kalyan Singh Bagga, Northville, MI (US); W. Bryan Snyder, Hanover Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 48 days.

(21) Appl. No.: 10/177,202

(22) Filed: Jun. 21, 2002

(65) Prior Publication Data

US 2003/0234003 A1 Dec. 25, 2003

(51) Int. Cl.[7] ..... F02M 7/00
(52) U.S. Cl. ..... 123/456; 123/447
(58) Field of Search ..... 123/456, 447, 123/468, 469, 198 D, 467; 138/26, 30

(56) References Cited

U.S. PATENT DOCUMENTS 5,373,824 A * 12/1994 Peters et al. ..... 123/527
5,575,262 A 11/1996 Rohde
5,577,478 A 11/1996 Tuckey
5,617,827 A 4/1997 Eshleman et al.
5,718,206 A * 2/1998 Sawada et al. ..... 123/470
5,896,843 A 4/1999 Lorraine
6,205,979 B1 3/2001 Sims, Jr. et al.
6,401,691 B1 * 6/2002 Kawano et al. ..... 123/456
6,439,199 B2 * 8/2002 Ramseyer et al. ..... 123/446

* cited by examiner

*Primary Examiner*—Mahmoud Gimie
(74) *Attorney, Agent, or Firm*—Dennis Kelly Sullivan; Susan L. Lukasik; Jeffrey P. Calfa

(57) ABSTRACT

A mechanical oscillator for attenuating pressure waves formed in a rail having a volume of fluid therein includes a rigid enclosed fluid cavity having a selected volume, the volume communicating with the rail actuating fluid though an orifice having a select volume for containing actuating fluid, the orifice having an aperture in fluid communication with the actuating fluid selected such that when an pressure wave impinges on the aperture of the orifice, the motion of the actuating fluid in the volume of the orifice is set to vibrating, the vibrating acting to excite the actuating fluid within the enclosed volume, a resulting amplified motion of the actuating fluid in the orifice, due to phase cancellation between the actuating fluid in the volume of the orifice and the actuating fluid volume in the enclosed cavity, causing energy absorption of the pressure wave due to frictional drag in and around the orifice. An pressure wave attenuator and a method of attenuation are also included.

29 Claims, 3 Drawing Sheets

PRESSURE WAVE ATTENUATOR FOR A RAIL

CROSS REFERENCE TO RELATED APPLICATION

This application is related to U.S. patent application Ser. No. 10/177,195, filed Jun. 21, 2002 and assigned to the assignee hereof.

TECHNICAL FIELD

The present invention relates to fluid rails for internal combustion engines. More particularly, the present invention relates to pressure wave attenuation for such rails.

BACKGROUND OF THE INVENTION

Electronically controlled, hydraulically actuated (HEUI) fuel injection systems use and actuating fluid (the actuating fluid preferably being engine lubricating oil, but other fluids are acceptable) rail to provide actuating fluid to each injector for generating high pressure fuel for the injection process.

Each injector has an actuating fluid control valve that is electronically controlled to control the time and amount of the actuating fluid flowing into the injector. The actuating fluid control valve initiates and terminates the injection process.

V-form engines typically have a separate rail servicing each of the two banks of cylinders. At the actuating fluid flow inlet of each rail, there may be a check valve in place to isolate the fluid communications between the separate rails servicing the two banks. For a V8 configuration, there are two rails with four injectors attached to each rail. For a V6 configuration, there are also two rails, but with three injectors attached to each rail. For an inline (typically I6) configuration, there is only one rail with six injectors attached to it and there is no check valve at the actuating fluid flow inlet as no rail isolation is needed for a single rail configuration.

The actuating fluid rail preferably has a cylindrical shape and a generally cylindrical fluid passageway defined therein. The actuating fluid is able to flow freely in the fluid passageway with the least amount of flow restrictions between the locations where injectors are connected to the rail. For the V8 and V6 configuration, the two actuating fluid rails are both connected through actuating fluid flow passages to the high-pressure actuating fluid pump, but separated by the aforementioned check valves at the inlet of the respective rails. These check valves provide isolation between the two actuating fluid rails for limiting the pressure dynamics inside a one of the actuating fluid rail induced by the pressure dynamics in the other actuating fluid rail.

During normal engine operating conditions, the injectors are actuated at evenly spaced times. When the injector is actuated for injection, the injector control valve opens for an interval and then closes providing the necessary amount of actuating fluid for the injection event in the interval. For an injection event that comprises single shot operation, the injector control valve opens and closes once. For an injection event that includes pilot operation (a small pilot injection followed by a much larger main injection), the valve opens and closes twice or more. When the control valve opens and closes either for a single shot injection event or for a multiple shot injection event, it generates a considerable amount of dynamic disturbance in the actuating fluid in the actuating fluid rail.

First, during the opening period of the control valve, there is relatively large amount of actuating fluid flowing from the actuating fluid rail into the injector for injection actuation. This causes a pressure drop in the actuating fluid rail. This pressure drop is then recovered by the supply actuating fluid flow from the high-pressure pump. Second, the open and close of the injector control valve generates fluid pressure waves along the actuating fluid rail. This pressure wave propagates along the axial direction of the actuating fluid rail with a frequency primarily determined by the length of the actuating fluid rail and the bulk modulus of the actuating fluid.

Since the length of the rail is determined to a large extent by the engine configuration, the frequency varies depending on the engine configuration. For V8 and V6 configurations, the frequency is around 1000–2000 HZ; for an I6 configuration, the frequency could be lower due to a longer rail, for example 800–1200 HZ. Because of this pressure wave, there is an unbalanced axial force on the actuating fluid rail since the pressure along the actuating fluid rail is different due to different time delay, or phase lag, at different locations along the actuating fluid rail. This unbalanced force has the same frequency as the pressure wave in the rail. The pressure wave interacts with the actuating fluid rail structure. A fraction of the pressure fluctuation energy converts to the undesirable air-borne acoustic energy. Also, the actuating fluid rail transmits an excitation with the above-mentioned frequency through the bolts connecting the rail to the rest of the engine (for bolt on rails). The same phenomenon occurs in rails formed in the engine structure. In both cases, this excitation then generates an audible noise with the same range of the above noted frequencies.

The audible noise resulting from the pressure waves is objectionable. A goal might be that a compression ignition engine be no more noisy than a typical spark ignition engine. Such a level of noise is deemed to be generally acceptable. This is not presently the case, however. In order to meet this goal, a number of sources of noise from the compression ignition engine need to be addressed. As indicated above, one such source is the pressure waves generated in the actuating fluid rail. There is then a need in the industry to attenuate the pressure waves generated in the rail.

SUMMARY OF THE INVENTION

The present invention is a mechanical oscillator for attenuating pressure or acoustic waves formed in a rail having a volume of fluid therein includes a rigid enclosed fluid cavity having a selected volume, the volume communicating with the rail actuating fluid though an orifice having a select volume for containing actuating fluid, the orifice having an aperture in fluid communication with the actuating fluid selected such that when an pressure wave impinges on the aperture of the orifice, the motion of the actuating fluid in the volume of the orifice is set to vibrating, the vibrating acting to excite the actuating fluid within the enclosed volume, a resulting amplified motion of the actuating fluid in the orifice, due to phase cancellation between the actuating fluid in the volume of the orifice and the actuating fluid volume in the enclosed cavity, causing energy absorption of the pressure wave due to frictional drag in and around the orifice. An pressure wave attenuator for a rail and a method of pressure wave attenuation in a rail are also included in the present invention.

DETAILED DESCRIPTION OF THE DRAWINGS

Figure 1:
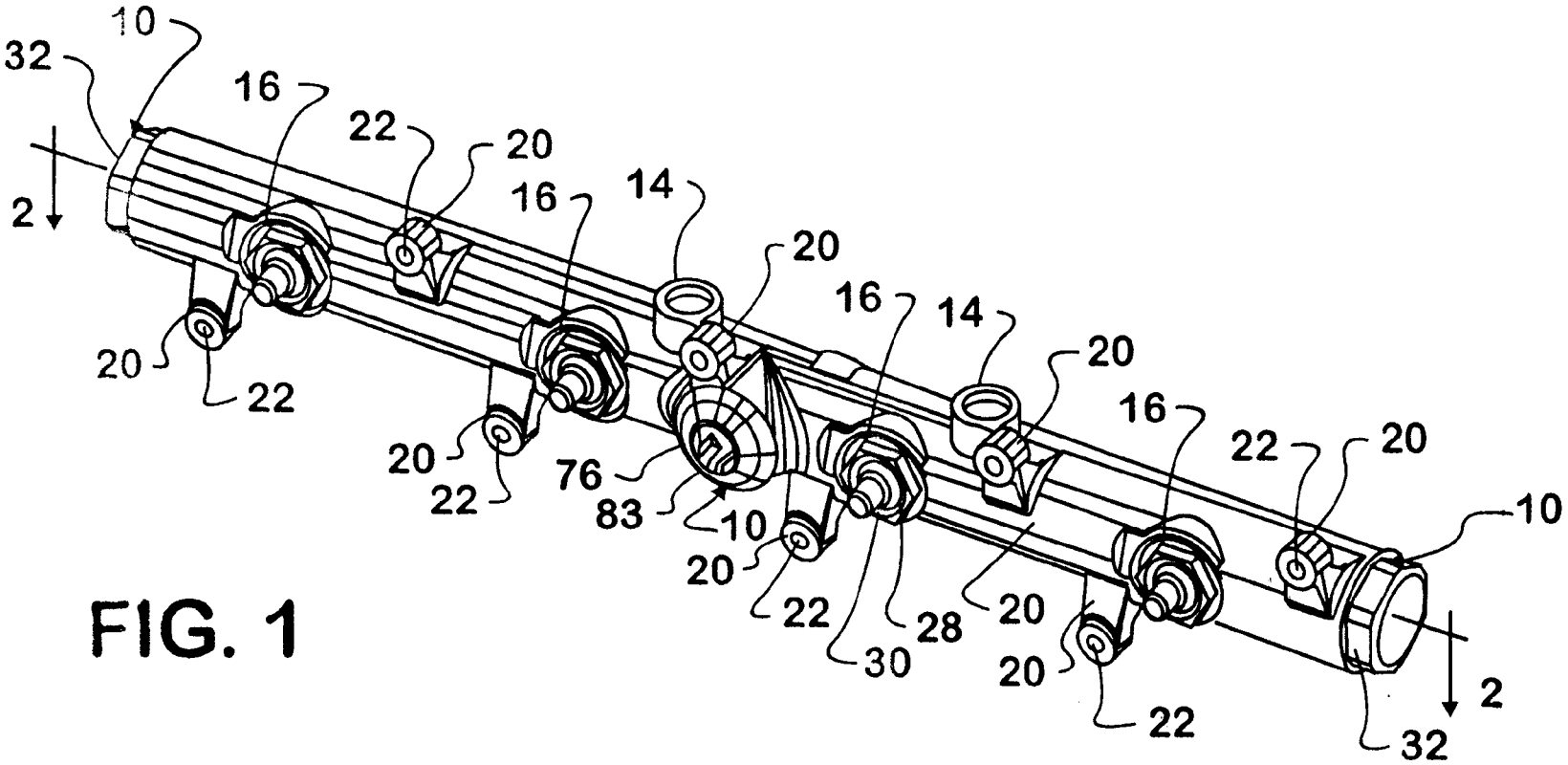
FIG. 1 is a perspective view of a rail having a center pressure wave attenuator.

Referring to FIG. 1, the concept for an acoustic or pressure wave attenuator (PWA) of the present invention is shown. The PWA is shown generally at 10 in the figures and is integrated with a rail 12.

The actuating fluid rail 12 preferably has a cylindrical shape and a generally cylindrical fluid passageway 18 defined therein. The actuating fluid is able to flow freely in the fluid passageway 18 with the least amount of flow restrictions between the locations of the injector ports 16 where injectors (not shown) are connected to the rail 12. For the V8 and V6 configuration, the two actuating fluid rails 12 are both connected through actuating fluid flow passages (not shown) via an pump inlet port 14 to a high-pressure actuating fluid pump (not shown), but separated by check valves (not shown) that may be advantageously disposed in the pump inlet port 14 of the respective rails 12. These check valves provide isolation between the two actuating fluid rails 12 for limiting the pressure dynamics inside one of the actuating fluid rails 12 induced by the pressure dynamics in the other actuating fluid rail 12.

Figure 2:
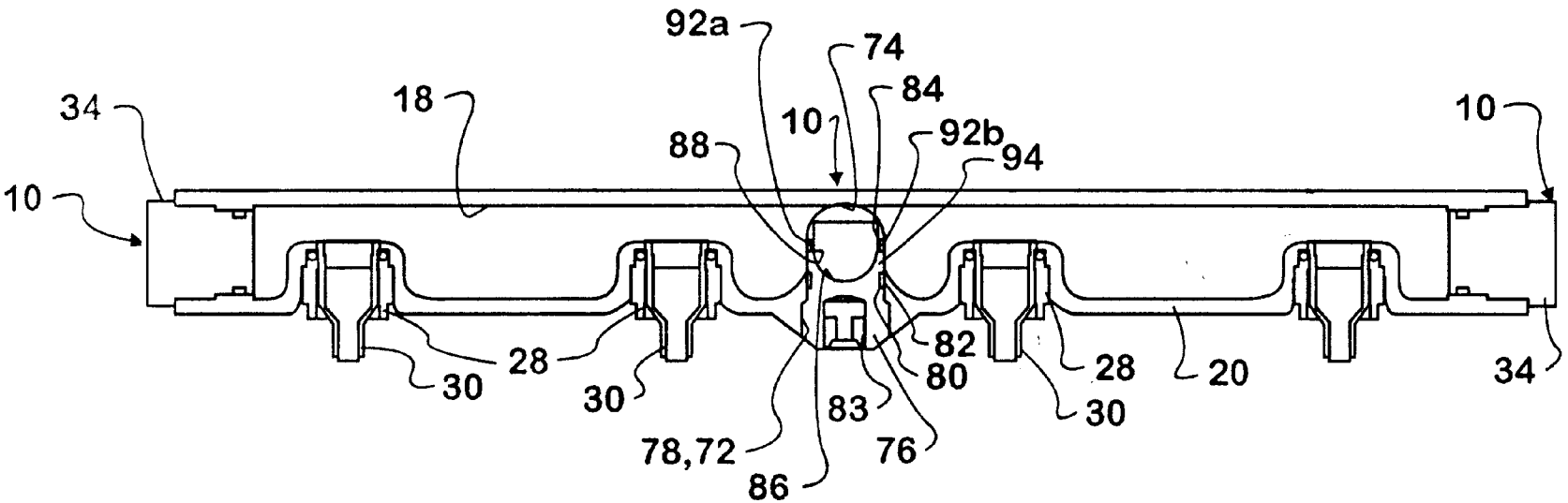
FIG. 2 is a sectional view of the rail taken along the line 2—2 of FIG. 1.

As noted above, FIGS. 1–3 depict a rail 12 for use with a V8 configured engine. The rail 12 includes the fluid inlet ports 14 for fluidly coupling the rail 12 to a high pressure actuating fluid pump. In practice one or the other of the inlet ports 14 is used depending on which bank of cylinders the particular rail 12 is servicing and the unused inlet port 14 is sealed by a suitable plug.

The actuating fluid rail 12 has a plurality of coupling lugs 20 for coupling the rail 12 to the engine. This is preferably accomplished by passing a bolt (not shown) through a bore 22 defined in the lug 20 and threading the bolt into a threaded bore (not shown) defined in the engine.

Injector ports 16 may have an aperture 26 that is in communication with the fluid passageway 18. The aperture 26 may define a receiver for receiving a ferrule 28. The ferrule 28 holds a jumper tube 30 in fluid communication with the fluid passageway 18. A ring seal 32 may form a fluid-tight seal between the jumper tube 30 and the fluid passageway 18. The jumper tube 30 is preferably coupled directly to a respective fuel injector and conveys actuating fluid from the fluid passageway 18 to the fuel injector. A respective injector port 16 services each respective fuel injector.

End caps 34 may fluidly seal the respective ends of the fluid passageway 18. The end caps 34, by being removable, assist in the formation of the passageway 18 in the rail 12.

The first depiction shows a center PWA 10. The PWA 10 need not be centrally disposed, and is not so disposed for a rail 12 that services a bank of cylinders of odd number, such as on a V6 configuration. In such configuration, the PWA 10 may be disposed between any two of the injector ports. For a V8 configured engine as depicted in FIG. 1, the PWA 10 is preferably disposed centrally, with two injector ports 16 on either side of the PWA 10, each respective port 16 servicing a respective fuel injector on the specific bank of cylinders served by the respective rail 12.

The AWA 10 is disposed in the fluid passageway 18 of the rail 12 approximately midway between the two end caps 34. In order to accommodate the PWA 10, a generally cylindrical aperture 70 is defined in the wall 20 of the rail 12. The longitudinal axis of the aperture 70 is preferably orthogonally disposed relative to the longitudinal axis of the rail 12. A portion of the aperture 70 includes inside threads 72. The aperture 70 is formed generally opposite a substantially hemispherical dome 74 that comprises a portion of the fluid passageway 18.

The PWA 10 includes an attenuator body 76. The attenuator body 76 has threads 78 defined on a portion of the outside margin of the attenuator body 76. The threads 78 are designed to engage the threads 72 in the aperture 70. A circumferential groove 80 is defined in the attenuator body 76. An O-ring seal 82 may be disposed in the groove 80 to define a fluid-tight seal between the attenuator body 76 and the cylindrical aperture 70. A hex receiver 83 is formed in the attenuator body 76. An Allen type wrench may be inserted in the hex receiver 83 in the attenuator body 76 for turning the attenuator body 76 into and out of the aperture 70.

A cavity 84 is defined in the attenuator body 76. The cavity 84 is domed in a generally hemispherical shape to cooperate with the hemispherical dome 74 to define a fixed substantially spherical attenuating cavity 96, described in more detail below. The cavity 84 is defined by the hemispherical portion 86 and a generally cylindrical portion 88. The cylindrical portion 88 is cylindrically shaped in order to facilitate the formation of the cavity 84 during the manufacture of the rail 12 and forms a cylindrical belt on the sphere that includes the spherical portion 86 and hemispherical dome 74 (see attenuating cavity 96 below). A purely spherical cavity 96 may be somewhat more desirable, but the cylindrical portion 88 is a compromise that facilitates formation of the cavity 84 without unduly sacrificing any attenuating properties of the cavity 84.

An opening 90 is defined at the upper margin of the attenuator body 76. When the attenuator body 76 is threaded into the cylindrical aperture 70, a sealing engagement is defined between the upper margin of the attenuator body 70 and the periphery of the hemispherical dome 74 at seal 91.

Figure 3A:
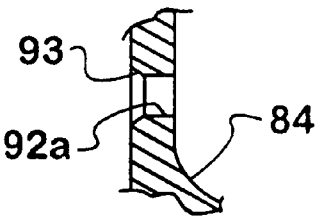
FIG. 3*a* is a sectional view of an orifice having a beveled aperture.
Figure 3:
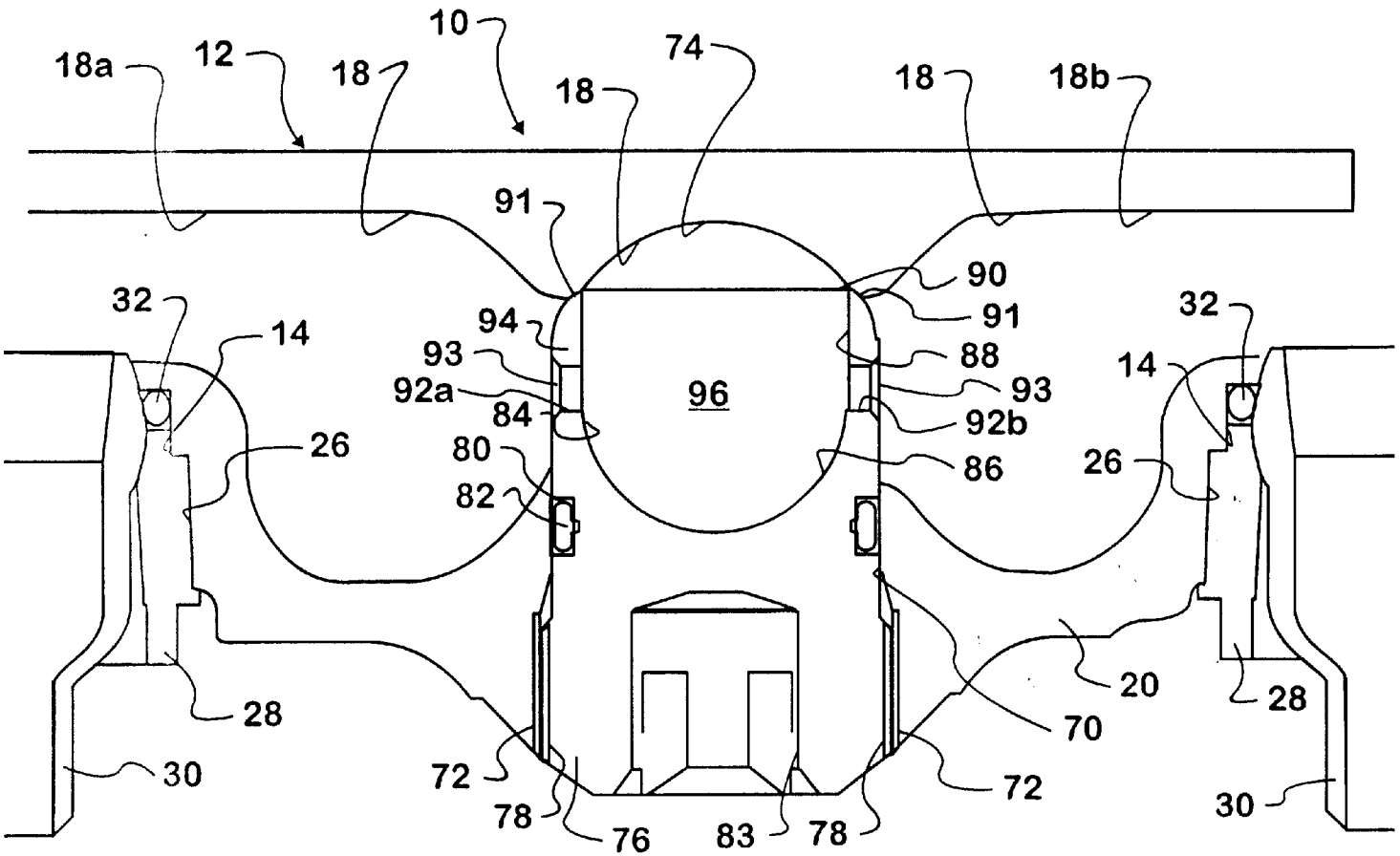
FIG. 3 is an enlarged sectional view of the center pressure wave attenuator of FIG. 2.

Orifices 92*a*, 92*b* are defined through the wall of the attenuator body 76. The orifices 92*a*, 92*b* have a length that is equal to the thickness of the wall 94. This length and the area of the orifices 92*a*, 92*b* defines the volume of the orifices 92*a*, 92*b*. The orifices 92*a*, 92*b* have an entrance aperture 93 that faces the respective fluid passageway 18*a*, 18*b*. The aperture 93 may be beveled, as depicted in FIG. 3*a*. The orifices 92*a*, 92*b* fluidly couple the first portion 18*a* of the fluid passageway 18 with the second portion 18*b* of the fluid passageway 18. Although two orifices 92*a*, 92*b* are shown, in practice for manufacturing reasons, five orifices 92 are uniformly spaced around the circumference of the attenuator body 76 so that when the attenuator is threaded into the aperture 70, one aperture 92 will face either the first portion or the second portion of the fluid passageway 18 while two will face the other passageway portion. The single orifice 92 is effective to limit the magnitude of the pressure waves passing through the attenuator body. The remaining two orifices will face the side walls of the passageway and have little effect.

The orifices 92*a*, 92*b* preferably have the same area, the same length, and the same volume. A consideration in determining the area is to provide for adequate actuating fluid flow between first portion 18*a* and second portion 18*b* to service the respective injectors during an injection event. When the rail 12 is charged with actuating fluid, a plug of actuating fluid resides in the volume defined by each of the orifices 92*a*, 92*b*. As noted below, this plug of actuating fluid plays a role in the attenuation effected by the PWA 10.

The attenuating cavity 96 is defined in part by the hemispherical dome 74 in cooperation with the cavity 84 defined in the attenuator body 76. The attenuating cavity 96 is therefore a generally belted-spherical shape, including the belt portion of the attenuating cavity 96 that is defined by the cylindrical portion 88, but may also be a spherical shape or generally spherical shape.

By introducing the PWA 10 of the present invention to the rail 12, the magnitude of the pressure wave produced in the fluid passageway 18 during operation of the respective injectors is significantly reduced. Therefore, the axial force on the actuating fluid rail 12 is also significantly reduced. This reduction of force oscillation helps the reduction of noise with the frequency of the pressure wave in the actuating fluid rail 12. The flow restricting orifices 92 can be designed in such a way that they effectively attenuate the force oscillations in the actuating fluid rail 12 while maintaining adequate actuating fluid flow to the respective fuel injectors in order to ensure proper injector performance.

The PWA 10 of the present invention substantially meets the aforementioned needs of the industry. In order to attenuate the pressure wave that is created due to the pressure fluctuations in the rail 12, the PWA 10 of the present invention provides the function of the acoustic energy absorption. When the linear dimensions of an acoustic system are small in comparison to the wavelength of the sound, the motion of the actuating fluid in the system is analogous to that of a mechanical system having lumped mechanical elements of mass, stiffness and damping.

The PWA 10 can be treated in terms of a mechanical oscillator. Such an attenuator 10 consists of a rigid enclosed volume (attenuating cavity 96), communicating with actuating fluid in the rail 18*a*, 18*b* though the small orifices 92*a*, 92*b* respectively. When the pressure wave impinges on the aperture 93 of the orifice, the actuating fluid in the orifice 92*a* or 92*b* is set to vibrating, which excites the plug of actuating fluid within the enclosed volume of the attenuating cavity 96 of the PWA 10. The resulting amplified motion of the actuating fluid in the orifice 92*a* or 92*b*, due to phase cancellation between the actuating fluid plug (in the volume defined between the aperture 93 and the cavity 96) in the orifice 92*a*, 92*b* and the actuating fluid volume in the enclosed cavity 96, causes energy absorption due to frictional drag in and around the respective orifice 92*a*, 92*b*. This type of attenuator 10 is tuned to produce a maximum absorption over a certain desired frequency range.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A mechanical oscillator for attenuating pressure waves formed in a fuel system actuating fluid rail having first and second ends and a volume of fluid in a fluid passageway therein, comprising a rigid enclosed fuel system fluid cavity defining at least a portion of a sphere and having a selected volume, the volume communicating with the rail actuating fluid passageway though an orifice having a select volume for containing actuating fluid, the orifice having an aperture in fluid communication with the actuating fluid selected such that when an pressure wave impinges on the aperture of the orifice, the motion of the actuating fluid in the volume of the orifice is set to vibrating, the vibrating acting to excite the actuating fluid within the enclosed volume, a resulting amplified motion of the actuating fluid in the orifice, due to phase cancellation between the actuating fluid in the volume of the orifice and the actuating fluid volume in the enclosed cavity, causing energy absorption of the pressure wave due to frictional drag in and around the orifice.

2. The mechanical oscillator of claim 1, the fluid cavity being disposed between the first and second ends of said rail thereby dividing the fluid passageway into a first portion and a second portion, the center fluid cavity having first and second orifices, the first orifice effecting fluid communication between the fluid cavity and the fluid passageway first portion, the second orifice effecting fluid communication between the fluid cavity and the fluid passageway second portion.

3. The mechanical oscillator of claim 1, the fluid cavity defining a belted sphere.

4. The mechanical oscillator of claim 1, the fluid cavity defining a sphere.

5. The mechanical oscillator of claim 1, the orifice including an aperture, the aperture facing the fluid passageway and being beveled to define a dimensionally decreasing entrance to the orifice as the orifice is approached from the fluid passageway.

6. The mechanical oscillator of claim 1, the cavity being defined in part in an attenuator body, the attenuator body being in fluid communication with the rail fluid passageway.

7. The mechanical oscillator of claim 6, the attenuator body being disposable in an aperture defined in a rail wall to intersect the rail fluid passageway.

8. The mechanical oscillator of claim 6, the attenuator body being threadedly installed in the rail fluid passageway.

9. An actuator rail assembly for conveying an actuating fluid under pressure to at least one fuel injector, comprising:

an elongate fluid passageway being defined in a rail and having first and second ends;

a fluid inlet port being in fluid communication with the fluid passageway, the inlet port being fluidly couplable to a source of actuating fluid under pressure;

a respective fluid outlet port being associated with each respective fuel injector and being fluidly couplable thereto for conveying actuating fluid to the respective fuel injector; and at least one fluid cavity defining at least a portion of a sphere and having at least one orifice, the orifice effecting fluid communication between the fluid cavity and the fluid passageway.

10. The actuator rail assembly of claim 9, a fluid cavity being disposed between the first and second ends and dividing the fluid passageway into a first portion and a second portion, the fluid cavity having a first and a second orifice, the first orifice effecting fluid communication between the fluid cavity and the fluid passageway first portion, the second orifice effecting fluid communication between the fluid cavity and the fluid passageway second portion.

11. The actuator rail assembly of claim 9, the fluid cavity defining a belted sphere.

12. The actuator rail assembly of claim 9, the fluid cavity defining a sphere.

13. The actuator rail assembly of claim 9, the orifice including an aperture, the aperture facing the fluid passageway and being beveled to define a dimensionally decreasing entrance to the orifice as the orifice is approached from the fluid passageway.

14. The mechanical oscillator of claim 9, the cavity being defined in part in an attenuator body, the attenuator body being in fluid communication with the rail fluid passageway.

15. The mechanical oscillator of claim 14, the attenuator body being disposable in an aperture defined in a rail wall to intersect the rail fluid passageway.

16. An actuator rail assembly for conveying an actuating fluid under pressure to at least one fuel injector, comprising:

an elongate fluid passageway defined in a rail; and at least one fluid cavity defining at least a portion of a sphere and having at least one throttling orifice, the orifice effecting fluid communication between the fluid cavity and the fluid passageway, the cavity having a volume filled with actuating fluid, a pressure wave in the fluid passageway exciting the volume of actuating fluid in the cavity, the excited volume of actuating fluid amplifying motion of the actuating fluid in the orifice to absorb the pressure wave above a certain frequency range.

17. The actuator rail assembly of claim 16, the certain frequency range being 800–2000 HZ.

18. The actuator rail assembly of claim 16, the amplified motion of the actuating fluid in the orifice effecting pressure wave phase cancellation between a plug of actuating fluid disposed in the orifice and the volume of actuating fluid in the cavity.

19. The actuator rail assembly of claim 18, the pressure wave phase cancellation causing energy absorption due to frictional drag in and proximate the orifice.

20. A pressure wave attenuator for use with an actuator rail assembly, the actuator rail assembly for conveying an actuating fluid under pressure to at least one fuel injector, comprising:

an attenuator body having at least a portion of a resonating fuel system fluid cavity defined therein, the cavity having two orifices, a first orifice effecting fluid communication between the fluid cavity and a first portion of the fluid passageway and a second orifice effecting fluid communication between the fluid cavity and a second portion of the fluid passageway wherein a frequency of resonance of the cavity is related to the velocity of sound in the actuating fluid, to the area and length dimensions of the two orifices, and to the volume dimension of the cavity.

21. The pressure wave attenuator of claim 20 being designed to resonate at a known frequency of an pressure wave occurring in the fluid passageway.

22. The pressure wave attenuator of claim 20, the cavity being substantially spherical.

23. The pressure wave attenuator of claim 22, the cavity being formed in cooperation with a hemispherical portion of the fluid passageway.

24. The pressure wave attenuator of claim 23 defining a substantially fluid-tight interface with the fluid passageway proximate a periphery of the hemispherical portion of the fluid passageway.

25. A pressure wave attenuator for use with an actuator rail assembly, the actuator rail assembly for conveying an actuating fluid under pressure to at least one fuel injector, comprising:

an attenuator body having at least a portion of a resonating fuel system fluid cavity defined therein, the cavity having two orifices, a first orifice effecting fluid communication between the fluid cavity and a first portion of the fluid passageway and a second orifice effecting fluid communication between the fluid cavity and a second portion of the fluid passageway, the attenuator body being threadedly disposed in the fluid passageway.

26. The pressure wave attenuator of claim 25 and the attenuator body having more than two orifices disposed to ensure that at least two orifices will open respectively to the first and second portions of the fluid passageway.

27. The pressure wave attenuator of claim 26 and the attenuator body having five orifices.

28. The pressure wave attenuator of claim 25 and the attenuator body orifices being uniformly spaced about the periphery of the attenuator body.

29. The pressure wave attenuator of claim 28 and the attenuator body having five orifices.

* * * * *